United States Patent [19]

Schoofs

[11] 4,151,690

[45] May 1, 1979

[54] DOUBLE GLAZED WINDOWS CONTAINING A MOLECULAR SIEVE ZEOLITE ADSORBENT HAVING A PREADSORBED LOW MOLECULAR WEIGHT POLAR MATERIAL

[76] Inventor: Richard J. Schoofs, 1605 School St., P.O. Box 67, Moraga, Calif. 94556

[21] Appl. No.: 900,052

[22] Filed: Apr. 26, 1978

Related U.S. Application Data

[63] Continuation-in-part of Ser. No. 740,352, Nov. 10, 1976, abandoned, which is a continuation-in-part of Ser. No. 603,267, Aug. 11, 1975.

[51] Int. Cl.[2] ..... E06B 7/12

[52] U.S. Cl. ..... 52/172; 428/34

[58] Field of Search ..... 52/172, 171; 55/75; 428/34

[56] References Cited

U.S. PATENT DOCUMENTS

| | | | |
|---|---|---|---|
| 2,882,243 | 4/1959 | Milton | 423/328 |
| 2,882,244 | 4/1959 | Milton | 423/331 X |
| 3,006,153 | 10/1961 | Cook | 55/75 X |
| 3,164,453 | 1/1965 | Milton | 55/75 X |
| 3,224,167 | 12/1965 | Jones | 55/75 X |
| 3,758,996 | 9/1973 | Bowser | 52/172 |
| 3,868,299 | 2/1975 | Ulisch et al. | 52/172 X |

*Primary Examiner*—Alfred C. Perham
*Attorney, Agent, or Firm*—Limbach, Limbach & Sutton

[57] ABSTRACT

An improvement in sealed insulating glass having an adsorbent disposed about all or part of the interior periphery of the glass is described. The improvement lies in employing a molecular sieve zeolite capable of adsorbing water and incapable of or having a very limited capacity for adsorbing nitrogen and oxygen as the adsorbent.

This capability is obtained by using a molecular sieve zeolite whose pore size of 3 angstrom units does not adsorb oxygen and nitrogen as well as employing a molecular sieve zeolite whose effective pore diameter of about 4 angstrom units or larger permit the entry of oxygen and nitrogen but which has acquired an ability to suppress such adsorbtion by being pretreated by preadsorbing a minor amount of a low molecular weight polar material such as water vapor, ammonia, methanol etc.

Preventing the adsorbtion and desorbtion of oxygen and nitrogen in a double glazed window eliminates pressure variations within the window space created by such gas movement.

8 Claims, No Drawings

DOUBLE GLAZED WINDOWS CONTAINING A MOLECULAR SIEVE ZEOLITE ADSORBENT HAVING A PREADSORBED LOW MOLECULAR WEIGHT POLAR MATERIAL

This application is a continuation-in-part of application Ser. No. 740,352 filed Nov. 10, 1976 now abandoned, which is in turn a continuation-in-part of application Ser. No. 603,267 filed Aug. 11, 1975.

BACKGROUND OF THE INVENTION

Double glazed windows have been in use for some time as described in "Windows—Performance, Design and Installation" by Beckett and Godfrey, Van Nostrand Reinhold, New York (1974). A double glazed window consists of two parallel panes of glass which are spaced apart to leave an air space between the two panes and having the periphery of the space between the two panes closed by a moderately flexible sealant which extends between the two panes along their peripheries, holding them apart and enclosing a generally rectangular parallelepiped body of air between the two panes. Polybutene resins and polysulfide resins are commonly used as sealants in the construction of the double glazed windows.

The purpose of a double glazed window is to provide thermal insulation and insulation against noise. At the time of their writing, Beckett and Godfrey noted the problem of condensation of water vapor contained in the air in the space between the two panes when the temperature of the air space drops below its dew point and noted that, "In the context of windows, condensation can occur both on the surface of the glass and on the frame facing the room and with double windows, additionally within the cavity between the two glazings. Whenever it occurs, the results can be very troublesome, impairing the view out and leading to the deterioration of the paint work and window frames." They note also that dehydrating agents and desiccants such as silica gel may be placed in the cavity to adsorb moisture from the entrapped air and so contribute to the suppression of condensation.

Double glazed windows, commonly referred to as sealed insulating glass, commonly have a narrow body of solid adsorbent positioned in the space between the two panes and lying in close proximity to the sealing resin which both holds the two panes together and apart. The solid adsorbent is commonly held in a generally rectangular aluminum tube which is either perforated or not completely sealed so that the enclosed air may have contact with the adsorbent and this adsorbent may lie along all or part of the interior periphery of the sealed insulating glass.

Passage of time and acquisition of experience has shown that condensation of water vapor is not the sole condensation problem attending the use of double glazed windows but that additionally over a period of time some decomposition of organic sealants occurs releasing condensible vapors such as hydrocarbon vapors or organic sulfide vapors which may also condense on the interior surface of the glass panes. It is current practice to use as the adsorbent to suppress condensation, a synthetic zeolite, sometimes referred to as a molecular sieve, or silica gel, or activated alumina, or a mixture of synthetic zeolite and a second adsorbent such as silica gel. The use of a second adsorbent to supplement large pore molecular sieve adsorbents was based on the observation that the rapid adsorption of water vapor by the molecular sieve reduces its capacity for adsorption of hydrocarbon vapors or organic sulfides. The molecular sieves which have been employed have all had pore diameters of such size that nitrogen molecules and oxygen molecules as well as water vapor molecules were able to penetrate the pores of the adsorbent.

The use of molecular sieve zeolites of this character has given rise to a problem which appears not to have been recognized heretofore, but if it has been recognized, either it has been ignored or no solution for it has been proposed so far as is now known.

The relatively recent discovery of the "energy problem" portends a great increase in the use of double glazed windows going far beyond current use in predominantly glass covered skyscrapers and extending to extensive use in dwelling houses and apartments.

The seemingly certain large increase in the use of double glazed windows suggests that they be constructed to provide maximum efficiency and life and suggests that the problem which attends the use of adsorbents which adsorb not only water vapor but also nitrogen and oxygen can no longer be ignored.

The problem may be defined as follows. In the northern part of the temperate zone the temperature of the air enclosed between the two panes of a double glazed window may easily rise to 110° F. or above on a warm summer day and may fall to 0° F. or below on a cold winter night. At the lower temperatures in this range, the molecular sieve zeolites currently used adsorb not only water vapor but also adsorb substantial amounts of oxygen and nitrogen. At higher temperatures adsorbed oxygen and nitrogen tend to be released from the adsorbent and migrate back into the gas space enclosed between the two panes. The resultant cycles of adsorption and desorption with temperature variation, both day-night variation and seasonal variation, results in significant changes in the pressure of the air enclosed between the two panes. The pressure of the enclosed air may commonly vary by 6% or more merely as a result of adsorption or desorption of oxygen and nitrogen. This pressure variation is, of course, amplified by the affect of temperature. For example, with rising temperature, not only are nitrogen and oxygen desorbed from the molecular sieve zeolites now in use, but in addition the rise in temperature itself causes an increase in the pressure of the gas enclosed between the two relatively rigid panes. Conversely, with falling temperature, the adsorption of nitrogen and oxygen increases with a resultant lowering of the pressure of the gas in the space enclosed between the two panes and in addition, the lowering of the temperature itself causes a further reduction in the pressure of the enclosed gas. These continuing fluctuations in pressure cause some distortion of view through the double glazed windows and, further, these fluctuations cause a backward and forward movement of the panes themselves with a resultant tendency to weaken the seals between the two panes formed by the resins and ultimately to permit openings between the exterior air and the enclosed air through the sealing resin which permits the enclosed space to more or less breathe with the result that over a period of time capacity of the adsorbent to take up additional water vapor introduced through such breathing is exhausted.

BRIEF DESCRIPTION OF THE INVENTION

Pursuant to the present invention, the adsorbent which is disposed along the periphery of the space enclosed by the two panes of a double glazed window is a mixture of two adsorbent components. One adsorbent suitable as a first component is a molecular sieve zeolite which strongly adsorbs water vapor and which is either incapable of adsorbing nitrogen and oxygen molecules or has been preconditioned so that its capacity to adsorb oxygen and nitrogen is greatly reduced. One specific adsorbent meeting these requirements is the 3 A molecular sieve manufactured and sold by Union Carbide Corporation and by W. R. Grace & Co. This material has an average pore diameter in the range about 3 angstrom units, strongly and readily adsorbs water vapor and it does not adsorb either oxygen or nitrogen.

The chemical composition of this particular molecular sieve is indicated by the following formula:

$$K_9Na_3[(AlO_2)_{12}(SiO_2)_{12}].XH_2O$$

The water content of the composition varies with the degree of dryness or activation of the zeolite but in the desired activated state should not exceed about 1.5% of the weight of the total composition. Other adsorbents suitable for use as the first component and which do not adsorb nitrogen or oxygen because of small average pore diameter may be obtained by starting with a sodium zeolite having average pore diameter size about 4 angstrom units and displacing a substantial part of the sodium with potassium. The resultant potassium or partly potassium sieve has a reduced average pore diameter which permits entry of water vapor molecules into the pores and excludes oxygen and nitrogen molecules from the pores.

Still another type of adsorbent which may be used as the first component of the mixture is a molecular sieve zeolite which has effective pore diameters which permit entry of oxygen and nitrogen into the pores, e.g., effective pore diameters of about 4 Å or larger but which has been pretreated by preadsorbing a minor amount of a low molecular weight polar material such as water vapor, ammonia, methanol, ethanol, methyl amine and the like. Preadsorption of such materials has been reported to suppress oxygen and nitrogen adsorption but the mechanism of the suppression has not been explained nor has use of such pretreated adsorbents in double glazed windows been suggested. [Breck, et al., *Journal of the American Chemical Society,* 78,5963 (1956)].

The second component of the adsorbent is either silica gel or activated alumina having average pore diameters which permit the adsorption of benzene vapor. Silica gel or activated alumina is placed in the air space between the panes of the double glazed window for the purpose of adsorbing hydrocarbon and/or organic sulfide vapors which get into the space enclosed between the two panes as a result of slow decomposition of the polysulfide or polyolefin resins which are commonly used to seal the periphery of the double glazed window and which cause staining or discoloration of the interior surfaces of the panes unless they are promptly removed from the enclosed air space. Activated carbon will also function efficiently as a second adsorbent but because of its color more than usual care must be taken to confine it to the periphery of the interior space in the double glazed window. Mixtures of two or more of silica gel, activated alumina and activated carbon may be used as the second adsorbent if desired.

DETAILED DESCRIPTION OF THE INVENTION

Molecular sieve zeolites now generally referred to in the art as Type A molecular sieve zeolites are described in U.S. Pat. No. 2,882,243. Type A zeolites are described as truncated cube octahedrons having an internal central cavity or cage of 11 A° diameter. The central cavities are entered through circular apertures of much smaller diameter, the diameter being determined by the specific cations contained. For instance, the Type 4 A molecular zeolite has the formula $Na_{12}[(AlO_2)_{12}(SiO_2)_{12}].XH_2O$. When fully hydrated X is 27, but the sieve is activated to give it adsorbent capability by heating to drive the water of crystallization off until the water content of the total composition is reduced to 1.5% by weight or below. The Type 4 A sieve has an aperture opening about 4 Å in diameter. When a substantial proportion of the sodium content of the 4 A sieve is replaced by potassium, the aperture diameter is reduced to about 3 Å. For example, the Type 3 A molecular sieve is formed by displacing sodium from the Type 4 A sieve with potassium to reach the formula $K_9Na_3[AlO_2)_{12}(SiO_2)_{12}].XH_2O$. The Type 3 A molecular sieve has aperture openings of 3 Å diameter. Other molecular sieves such as Type 5 A, Type 10X, Type 13X, etc. have larger aperture openings.

Directionally, the diameter of the aperture opening determines which molecules will be able to pass through the aperture opening into the central cage of the zeolite and so be adsorbed. It might be expected that the molecular sieve having aperture openings of 4 Å would permit entry of molecules having a kinetic diameter less than 4 Å and exclude from entry into the central cavity molecules having kinetic diameters greater than 4 Å. The matter of entry and exclusion, however, is not quite that simple. Breck and Smith writing in *Scientific American,* January 1959, note, "One might expect that molecules more than a 3.5 angstrom in diameter would be unable to enter the crystals (of a Type A sieve having aperture diameters of 3.5 angstroms) but the reality is not quite so simple. We find, for example, that ethane molecules with a diameter of 4 angstrom units readily pass through the 3.5 angstrom apertures at normal temperatures; propane molecules 4.9 angstrom units in diameter do not. The reason becomes clear enough when we recall that atoms are not rigid bodies. They more nearly resemble pulsating rubber balls. The pulsations of both the aperture atoms and the incoming molecules combine to make the effective diameter of the aperture considerably larger than its free diameter of 3.5 angstroms. Moreover, the kinetic energy of the incoming molecules helps them to 'shoulder their way' through the opening. We have found in general that at ordinary temperatures molecules up to 0.5 angstroms wider than the free diameter of the aperture can pass through it easily. Larger molecules enter the crystal with greater and greater difficulty; molecules 1 angstrom wider cannot enter at all."

The quoted material above indicates the difficulty of defining a molecular sieve zeolite which will admit certain molecules and exclude others in terms of aperture diameter and kinetic diameter of the molecules. In order to know whether a molecular sieve having a given aperture diameter will admit or exclude molecules having a kinetic diameter greater than the aperture opening but not more than 1 angstrom greater, it is necessary to make a simple test by exposing the molecular sieve to the materials with which it may be hoped will be excluded and determine whether or not they are admitted or excluded.

The Type 3 A molecular sieve admits and adsorbs water molecules and excludes oxygen molecules and nitrogen molecules. The minimum kinetic diameter of a water molecule has been reported at 2.65 Å and the minimum kinetic diameters of oxygen and nitrogen molecules, respectively, at 3.46 and 3.64 Å. To determine whether a molecular sieve prepared by displacing part of the sodium from a 4 A sieve with potassium will admit or exclude nitrogen and oxygen requires a simple test of this sort if less than half of the sodium has been displaced.

As noted above, the essential property of a molecular sieve zeolite which can be used to solve the problem of pressure swings in the space between the panes of double glazed windows is that the zeolite be capable of adsorbing water vapor and incapable of or having only a limited capacity for adsorbing oxygen and nitrogen. 3 A molecular sieve has this essential property because its average pore diameters are too small to permit entry of oxygen or nitrogen molecules into the pores. Molecular sieves such as Types 4 A, 5 A, 10X, 13X and the like have average pore diameters which permit entry of oxygen and nitrogen molecules into the pores, but if they are pretreated by preadsorbing a small amount of a low molecular weight polar material such as water vapor, ammonia, methanol, ethanol, methyl amine and the like, then their adsorption of oxygen and nitrogen is greatly reduced, i.e., to less than 20 percent of the adsorption that would occur absent the pretreating. For convenience, molecular sieve zeolite adsorbents having average pore diameters about 4 Å or larger on which minor amounts of low molecular weight polar materials have been preadsorbed will be referred to hereinafter as pretreated zeolites.

The quantity of low molecular weight polar material preadsorbed on the pretreated zeolites consists of minor amounts up to about 0.05 ml. per gram of zeolite, preferably in the range 0.0125 to 0.05 of normal density liquid polar material per gram of activated zeolite. Expressed in another way, the quantity of adsorbed polar material involves minor amounts up to about 4 percent of the weight of the zeolite, preferably in the range 1 to 4 percent.

The case of water which is a preferred polar material requires special comment. The zeolites freshly prepared have a high water content and in order to impart adsorptive activity to the zeolite, it is dehydrated at 350° C. or higher, the water content being reduced below 1.5 percent by weight as a maximum and usually to a level about 1 percent by weight. The residual water content is probably not adsorbed water but probably water of crystallization. At all events, when water is used as the preadsorbed polar liquid, the preadsorption is carried to the point where the total water content of the zeolite is from above 1.5 to about 4 percent by weight. It should be noted that one could reach water content levels in this range by controlling the activation by dehydration to leave about 1.5 to about 4 percent by weight of water in the zeolite. Water in amounts above 1.5 percent by weight has the same effect as preadsorbed water and for present purposes such excess water is considered preadsorbed.

The desired level of preadsorbed water can be accurately fixed by heating the adsorbent to a temperature of 600° F. and maintaining it at such temperature for a period of four hours. A stream of dry air is passed over the adsorbent during the four-hour period. At the end of the four-hour period the adsorbent is fully activated. The resulting fully activated adsorbent is cooled and then exposed to water vapor until it shows a weight increase of 1.5 to 4 percent. It is then ready for use in a double glazed window where it will adsorb water vapor from the air filling the space between the panes but will not adsorb oxygen or nitrogen.

The use of water as the polar material preadsorbed presents an apparent difference between water and the other polar adsorbents in the sense of total polar material present in the adsorbent because of the fact that the activated zeolites have a water content as water of crystallization. In the case of water, the preadsorption must be carried to the point where the total water content of the adsorbent is generally in the range above 1.5 up to 4 percent by weight. In the case of ammonia and the other polar adsorbents, preadsorption to give the adsorbent a polar material content in minor amounts up to about 4 percent adequately suppresses oxygen and nitrogen adsorption, preferably amounts in the range 0.75 to 4 percent.

The effective quantity of preadsorbed polar material may also be expressed in terms of percent of capacity of the adsorbent to adsorb the polar material, so expressed the quantity of polar material is sufficient to exhaust from about 3 to 15 percent of the adsorptive capacity of the zeolite for the particular polar material adsorbed.

Adsorbents for use in double glazed windows to control condensation of water vapor and of hydrocarbons or organic sulfides on the interior surfaces of the panes may be prepared by mixing Type 3 A molecular sieve zeolite with either a silica gel adsorbent or an activated alumina adsorbent having pore diameters sufficiently large to permit the adsorption of benzene molecules.

These adsorbent mixtures should contain a minimum of about 15 percent by weight of the Type 3 A molecular sieve zeolite or pretreated zeolite and a minimum of about 25 percent by weight of silica gel or activated alumina. Both adsorbents are in the form of small particles having a mesh size generally in the range 10 to 30. The mesh size of the particles is not critical but sizes in this range facilitate filling the perforated aluminum tubes which are laid along the interior periphery of the double glazed window.

An alternate heretofore unrecognized solution to the problems associated with the adsorption and desorption of oxygen and nitrogen is one in which a second adsorbent component is not required. It involves the use of a molecular sieve with pores sufficiently large to permit the adsorption of benzene vapor, i.e., having effective pore diameters above 6 Å, preferably 6 Å to 13 Å, but which has been pretreated by preadsorbing a minor amount of a low molecular weight polar material such as water vapor, ammonia, methanol, ethanol, methyl amine and the like. When disposed along the periphery of the space enclosed by the two panes of a double glazed window, these pretreated larger pore molecular sieves are capable of coadsorbing hydrocarbon and organic sulfide vapors and additional water vapor, but pressure fluctuations due to the adsorption and desorption of oxygen and nitrogen would be eliminated or greatly reduced.

The quantity of the adsorbent mixture theoretically required to control water vapor condensation and hydrocarbon condensation is quite small being somewhat less than 7 grams for a 3 foot by 5 foot double glazed window having a one-half inch space between the panes. Because, however, minor imperfections in the sealing of the two panes of double glazed windows are unavoidable in a fair proportion of them which permits migration of water vapor from the outside air into the interior space, because hydrocarbon or organic sulfide release is more rapid during the curing of the resin and prompt removal of these vapors is necessary to avoid staining of the interior surface, and because consumers are demanding extended warranties on the life of double glazed windows, the quantity of adsorbent disposed along the periphery of the interior space should be a quantity in the range about 0.01 gram to 1.0 gram of adsorbent for each cubic inch of space enclosed between the two panes, larger amounts may be used if desired but ordinarily no benefit attends the use of larger amounts. In the event that more than two panes of glass are used, i.e., a triple glazed window is produced the same adsorbent loading would be used in the spaced between adjacent panes.

While it is preferred to use a mixture of particulate molecular sieve zeolite with particulate silica gel, activated alumina or activated carbon, effective suppression of condensation with simultaneous avoidance of pressure fluctuations due to nitrogen and oxygen adsorption and desorption may be achieved by filling some rectangular aluminum tubes with the molecular sieve zeolite and others with the second adsorbent and then placing zeolite filled tubes along one or more peripheral sides of the space enclosed between the two panes and tubes filled with the second adsorbent along one or more of the remaining peripheral sides. Additionally, the filling of the rectangular aluminum tubes may be carried out not only by pouring granular adsorbent into the tubes but also, if desired, the adsorbents may be compressed into rod-like shape sized to slide into the aluminum tubes.

While the greater proportion of the double glazed windows now manufactured employ the combination of polyolefin or polysulfide resins and adsorbent filled aluminum tubes to maintain spacing between the two panes and seal the periphery of the space enclosed between the panes, some double glazed windows are manufactured using lead strips and an adhesive to close the space between the panes and maintain the spacing between them. In such windows, the second adsorbent is not required because there are no resin decomposition products to contend with, only a zeolite molecular sieve adsorbent capable of adsorbing water vapor and incapable of adsorbing nitrogen and oxygen need be used. In this type of double glazed window, from about 0.01 to 0.6 grams of adsorbent per cubic inch of enclosed space adequately suppress water vapor condensation.

What is claimed is:

1. In a double glazed window having two parallel panes of glass spaced apart to leave a rectangular parallelepiped space between the panes, having the peripheries of the two panes sealed to enclose said air space and having a molecular sieve zeolite adsorbent disposed along all or part of the interior periphery of the enclosed air space, the improvement which comprises employing as the adsorbent a molecular sieve zeolite having effective pore apertures of about 4 Angstrom units or larger and having preadsorbed on it a low molecular weight polar material in minor amount sufficient to exhaust up to about 15 percent of the capacity of the zeolite for adsorption of the polar material.

2. In a double glazed window having two parallel panes of glass spaced apart to leave a rectangular parallelepiped air space between the panes, having the peripheries of the two panes sealed with a flexible resin to enclose said air space and having an adsorbent adapted to prevent condensation on the interior surfaces of the panes disposed along all or part of the periphery of the enclosed air space, the improvement which comprises employing as the adsorbent a mixture of a particulate molecular sieve zeolite having an effective pore diameter about 4 Angstrom units or larger and having preadsorbed on it a low molecular weight polar material in minor amount sufficient to exhaust from about 3 to 15 percent of the capacity of the zeolite for adsorption of the polar material, and a particulate non-zeolite adsorbent having a strong affinity for hydrocarbon adsorption and an average pore diameter which permits entry of benzene molecules into the pore space.

3. In a double glazed window having two parallel panes of glass spaced apart to leave a rectangular parallelepiped space between the panes, having the peripheries of the two panes sealed to enclose said air space and having a molecular sieve zeolite adsorbent disposed along all or part of the interior periphery of the enclosed air space, the improvement which comprises employing as the adsorbent a molecular sieve zeolite having effective pore apertures of about 4 Angstrom units or larger and having water vapor preadsorbed on it in quantity sufficient to give the zeolite a total water content in excess of 1.5 percent and up to about 4 percent by weight.

4. In a double glazed window having two parallel panes of glass spaced apart to leave a rectangular parallelepiped air space between the panes, having the peripheries of the two panes sealed with a flexible resin to enclose said air space and having an adsorbent adapted to prevent condensation on the interior surfaces of the panes disposed along all or part of the periphery of the enclosed air space, the improvement which comprises employing as the adsorbent a mixture of a particulate molecular sieve zeolite having an effective pore diameter about 4 Angstrom units or larger and having water vapor preadsorbed on it in amount sufficient to give the molecular sieve zeolite a total water content in the range greater than 1.5 percent and up to about 5 percent by weight, and a particulate non-zeolite adsorbent having a strong affinity for hydrocarbon adsorption and an average pore diamter which permits entry of benzene molecules into the pore space.

5. In a double glazed window having two parallel panes of glass spaced apart to leave a rectangular parallelepiped space between the panes, having the peripheries of the two panes sealed to close said air space and having a molecular sieve zeolite adsorbent disposed along all or part of the interior periphery of the enclosed air space, the improvement which comprises employing as the adsorbent a molecular sieve zeolite having effective pore apertures large enough to adsorb benzene vapor and having water vapor preadsorbed on it in quantity sufficient to give the zeolite a total water content in excess of 1.5 percent and up to about 4 percent by weight.

6. The improvement defined in claim 5 wherein the molecular sieve zeolite disposed along the periphery of the enclosed space is Molecular Sieve Type X.

7. The improvement defined in claim 1 wherein the preadsorbed polar material is water.

8. In a double glazed window having two parallel panes of glass spaced apart to leave a rectangular parallelepiped air space between the panes, having the peripheries of the two panes sealed to close said air space and having a molecular sieve zeolite adsorbent disposed along all or part of the interior periphery of the enclosed air space, the improvement which comprises employing as the adsorbent a molecular sieve zeolite having pore diameters of about 4 Angstrom units or larger and having a minor amount of water preadsorbed on it, the quantity of preadsorbed water being a quantity of water which increases the weight of the adsorbent by from 1.5 to 4 percent of its weight determined just after maintaining the adsorbent at 600° F. for four hours.

* * * * *